United States Patent [19]

Ito

[11] 4,446,728

[45] May 8, 1984

[54] ROTARY DRIVE DEVICE FOR INSPECTING TURBO-FAN ENGINE BLADES

[75] Inventor: Tomoo Ito, Futtu, Japan

[73] Assignee: Jupitor Corporation, Tokyo, Japan

[21] Appl. No.: 373,696

[22] Filed: Jun. 9, 1982

[30] Foreign Application Priority Data

Jan. 26, 1982 [JP] Japan ..... 57-9475

[51] Int. Cl.[3] ..... G01M 15/00

[52] U.S. Cl. ..... 73/116; 73/168

[58] Field of Search ..... 73/168, 116, 118, 432 V

[56] References Cited

U.S. PATENT DOCUMENTS 2,164,000 6/1939 Keller ..... 73/168

4,055,994 11/1977 Rosiyng ..... 73/168

*Primary Examiner*—S. Clement Swisher

*Attorney, Agent, or Firm*—Wegner & Bretschneider

[57] ABSTRACT

This invention discloses a rotary drive device for mechanically rotating the blades of a turbo-fan engine for inspecting the blades. The device is mounted on a blade and has a pulley in frictional contact with the turbo-fan case. A motor in the device continuously or intermittently rotates the blades with respect to the turbo-fan case.

6 Claims, 4 Drawing Figures

ROTARY DRIVE DEVICE FOR INSPECTING TURBO-FAN ENGINE BLADES

BACKGROUND OF THE INVENTION

1. Field of the Invention

The present invention relates to a rotary drive device for inspecting blades of a turbo-fan engine.

2. Description of the Prior Art

Turbo-fan Engines, particularly those for aircraft require periodic inspection of compressor blades or fan and low-pressure turbine blades since a damage or a failure in such essential components of the engine may lead to a serious accident.

Although there are known various types, the turbo-fan engine essentially comprises a high-pressure compressor, a low-pressure compressor and related turbines, wherein the high-pressure compressor and the corresponding turbine are linked with a drive mechanism through gears while the low-pressure compressor or fan and the corresponding turbine are not linked with said drive mechanism and are freely rotatable by air stream. Consequently the blades of the high-pressure compressor and the corresponding turbine can be visually inspected by rotating said compressor and turbine externally by said drive mechanism at a suitable speed, but the low-pressure compressor or fan and the corresponding turbine cannot be rotated externally due to the lack of gear linkage as explained above and have to be manually rotated gradually for the blade inspection. Although such manual rotation of the fan blades is relatively easy in an engine in which the fan blades are easily accessibly positioned in the vicinity of the front air inlet of the rocket-shaped fan case housing the turbo-fan engine, an engine having deep blade position requires the inspector to lie down in order to make such access, and the operation of blade inspection with manual rotation of the fan blades in such lying posture is quite toilsome for the inspector.

SUMMARY OF THE INVENTION

In consideration of the foregoing, the object of the present invention is to provide a rotary drive device for mechanically rotating the fan blades for facilitating the blades of a turbo-fan engine.

DESCRIPTION OF THE PREFERRED EMBODIMENTS

Figure 1A:
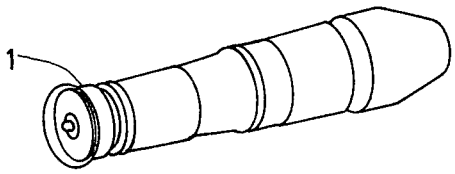
FIG. 1A is a schematic external view of an aircraft turbo-fan engine.
Figure 1B:
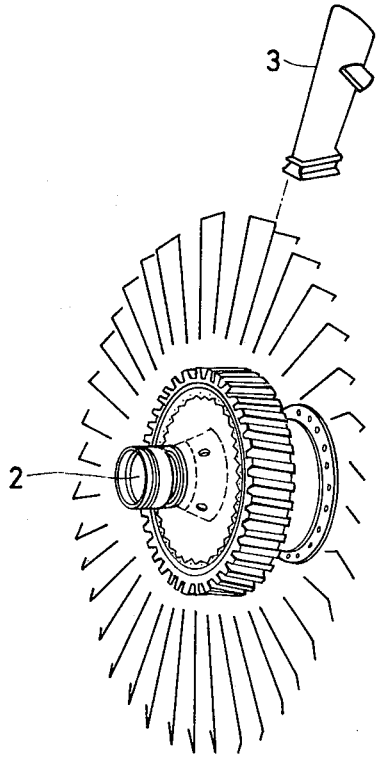
FIG. 1B is a perspective view of fan blades positioned at the front aperture of the turbo-fan engine shown in FIG. 1A.

FIG. 1A shows the external view of an aircraft turbo-fan engine in which various blades are housed in a rocket-shaped fan case 1. At the front air inlet of said fan case 1 provided rotatably is a fan blade rotor 2 as shown in FIG. 1B, having a plurality of fan blades 3 radially mounted on a rotor shaft. The fan blades 3 may be cracked or damaged by stress under high-speed air stream or by external impact. Such defective blades have to be replaced by proper blades in order to prevent serious accident, and for this reason the fan blades have to be periodically inspected in addition to the maintenance of engine parts.

Figure 2:
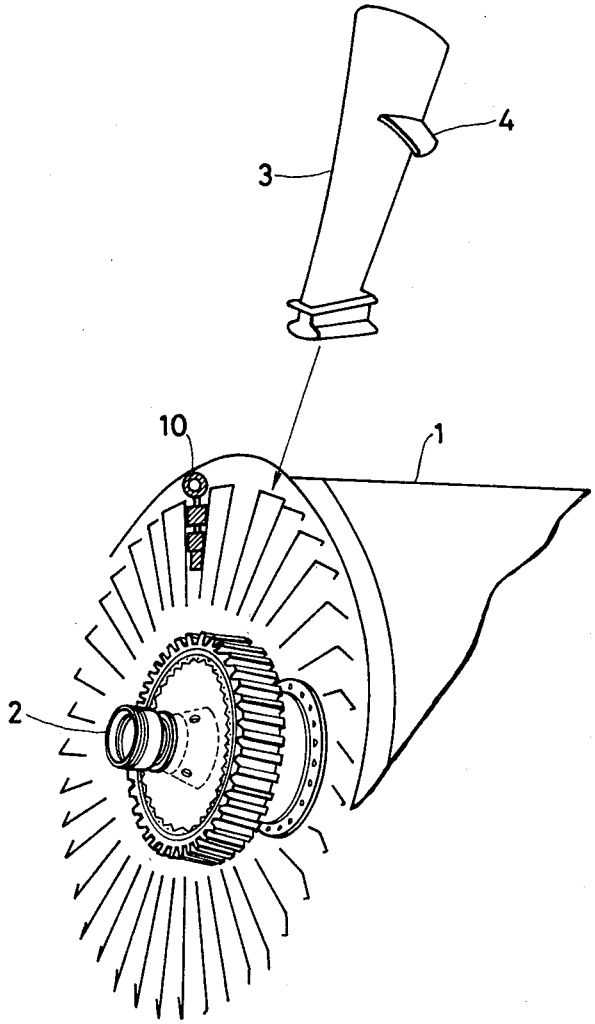
FIG. 2 is a schematic view showing the rotary drive device of the present invention mounted on the fan blades of the turbo-fan engine shown in FIG. 1B.

The rotary drive device of the present invention is adapted to rotate the fan blades continuously or intermittently by a determined angle at the blade inspection. FIG. 2 shows said rotary drive device 10 mounted on the fan blades 3. More specifically said rotary drive device 10 is mounted on a half-vane shroud 4 functioning as a spacer between fan blades 3, and a pulley of said device is maintained in pressure contact with the internal wall of the fan case 1 as will be explained in relation to FIG. 3. Rotation of said pulley causes said pulley to travel along the internal wall of the fan case 1, whereby said rotary drive device 10 mounted on the half-vane shroud 4 causes the rotation of the fan blade rotor 2.

The blade inspection is conducted visually through a borescope or a fiberscope maintained close to said blades, or through a display device connected to such borescope or fiberscope. Since the viewing field of such borescope or fiberscope is limited, the blade inspection is effected by rotating the fan blade plural turns while displacing the position of said fiberscope radially in each turn of the fan blade, thereby scanning the blade in peripheral direction.

Also the blade inspection can be effected during continuous rotation of the fan blade rotor or in the intervals between intermittent rotation of the fan blade rotor by a determined angle. The angle of such rotation and the duration of said interval are controlled by a control device 20 connected to the rotary drive device of the present invention, and said control device 20 is equipped with an unrepresented counter for indicating the number of blade under inspection. The function of the control device is not directly related to the present invention and will not be discussed in detail.

Figure 3:
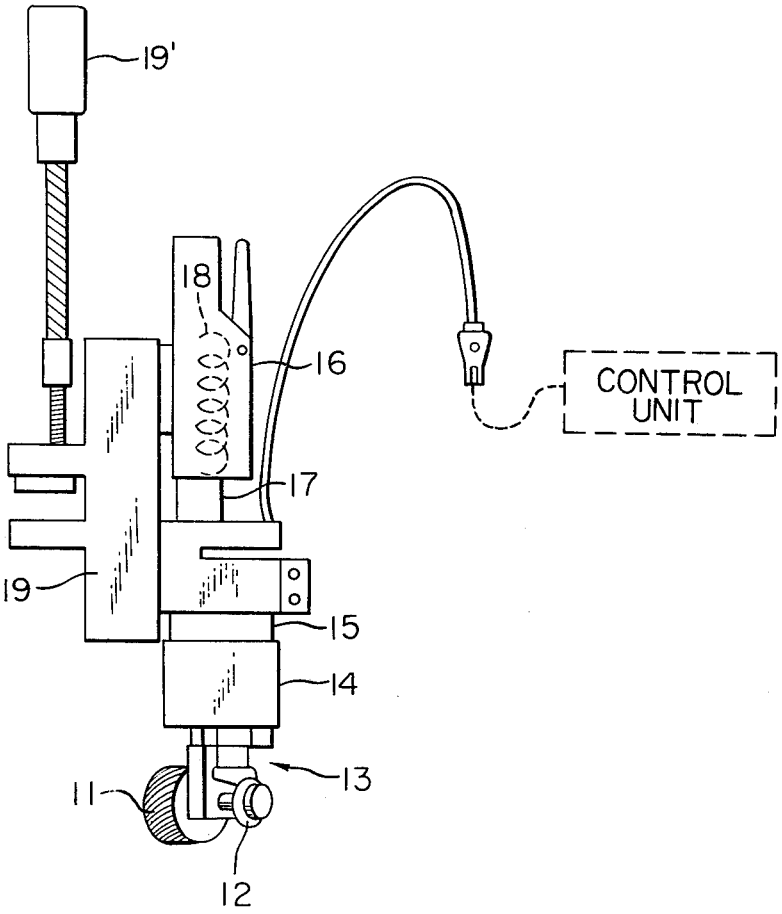
FIG. 3 is a schematic view of the rotary drive device of the present invention.

FIG. 3 schematically shows the rotary drive device 10 of the present invention, in which an elastic pulley 11 composed for example of neoprene for frictional engagement with the internal wall of the fan case is linked to a gear assembly 13 having a bevel gear 12 for transmitting the drive power. The gear assembly 13 is linked to a motor assembly 14 having a reversible DC motor 15.

The motor assembly 14 is fixed to a plunger 17 slidably fitted in a cylinder 16, in which a spring 18 is provided for biasing the plunger in one direction. The cylinder 16 is further provided with support means 19 of a vice structure for pinching the half-vane shroud 4 by a handle 19'.

By fixing the support means 19 on the half-vane shroud 4 in such a manner that the pulley 11 comes into contact with the internal wall of the fan case 1, the spring 18 provided in the cylinder 16 biases the pulley 11 toward the internal wall of the fan case 1. Motor 15 is intermittently rotated by intermittent DC power supply controlled by the control device 20, thereby causing intermittent rotation of the fan blade rotor 2 by a determined angle and allowing visual inspection of the blade in the intervals of the intermittent rotations.

As explained in the foregoing, the rotary drive device of the present invention allows intermittent and reversible rotations of the fan blade by simple mounting on said fan blade, thereby improving the efficiency and accuracy of the blade inspection.

What I claim is:

1. A rotary drive device for turbo-fan engine at blade inspection, comprising:

a pulley maitained in frictional engagement with the fan case of said engine for rotating fan blades thereof with respect to said fan case;

a power transmitting mechanism for transmitting rotary power to said pulley;

a motor for rotating said pulley through said power transmitting mechanism;

support means for supporting and detachably mounting said motor, power transmitting mechanism and pulley on said fan blades; and biasing means for maintaining said pulley in pressure contact with said fan case when said support means is mounted on said fan blades.

2. A rotary drive device for turbo-fan engine at blade inspection according to claim 1, wherein said motor is a reversible DC motor.

3. A rotary drive device for turbo-fan engine at blade inspection according to claim 1, wherein said biasing means comprises a spring compressed in a cylinder fixed on said support means for biasing a plunger.

4. A blade inspection method for a turbo-fan engine comprising the steps of mounting the rotary drive device on a turbo-fan blade;

maintaining the pulley of said rotary drive device in frictional contact with the internal wall of the turbo-fan case; and activating the motor to rotate the turbo-fan relative to the turbo-fan case.

5. A blade inspection method according to claim 4, wherein said motor is reversibly and intermittently driven by pulses of two polarities.

6. A blade inspection method according to claim 4 or 5, wherein remote inspection of cracks, defects or irregularities on the fan blades is made by a borescope positioned close to the turbo-fan blades during rotation of said turbo-fan blades.

* * * * *